US005240213A

United States Patent [19]

Horcher

[11] Patent Number: 5,240,213

[45] Date of Patent: Aug. 31, 1993

[54] HOLDER FOR MOUNTING A GUIDE RAIL FOR A LIFT ON A CEILING

[76] Inventor: Willi Horcher, Hainstr. 7, D-6269 Schöneck 1, Fed. Rep. of Germany

[21] Appl. No.: 702,071

[22] Filed: May 17, 1991

[30] Foreign Application Priority Data

May 18, 1990 [DE] Fed. Rep. of Germany ..... 4015970

[51] Int. Cl.[5] ..... F16L 3/08

[52] U.S. Cl. ..... 248/223.4; 16/94 R; 52/710

[58] Field of Search ..... 248/223.4, 224.1, 224.2, 248/220.2, 222.1, 72, 228, 73; 52/710, 698, 665, 39; 160/345, 346, 900, 902; 16/87.4 R, 94 R, 95 R, 96 R

[56] References Cited

U.S. PATENT DOCUMENTS

| | | | |
|---|---|---|---|
| 2,805,820 | 9/1957 | Evarts | 248/223.4 X |
| 2,831,412 | 5/1958 | Friedman | 248/223.4 X |
| 3,243,153 | 3/1966 | Kelly et al. | 248/72 |
| 3,327,644 | 6/1967 | Black . | |
| 3,543,462 | 12/1970 | Spratt | 52/698 X |
| 3,631,572 | 1/1972 | Lange | 248/223.4 |
| 3,807,675 | 4/1974 | Seckerson | 248/223.4 |
| 3,900,998 | 8/1975 | Hubbard | 52/698 |
| 3,915,189 | 10/1975 | Holbrook | 248/223.4 |
| 3,928,894 | 12/1975 | Bury | 248/223.4 |
| 3,975,792 | 8/1976 | Janson | 16/87.4 R |
| 4,417,373 | 11/1983 | Keglewitsch | 248/224.2 X |
| 4,475,706 | 10/1984 | Anderson | 16/94 R X |

FOREIGN PATENT DOCUMENTS

| | | | |
|---|---|---|---|
| 1195788 | 7/1965 | Fed. Rep. of Germany . | |
| 1240469 | 5/1967 | Fed. Rep. of Germany . | |
| 516694 | 1/1972 | Switzerland . | |
| 1063713 | 3/1967 | United Kingdom | 248/223.4 |
| 2216857 | 10/1989 | United Kingdom . | |

*Primary Examiner*—David M. Purol
*Assistant Examiner*—Korie H. Chan
*Attorney, Agent, or Firm*—Collard & Roe

[57] ABSTRACT

A holder for mounting a guide rail on a ceiling comprises a carrier defining a plane and comprised of two separate and unconnected plates attachable to the ceiling and defining a gap therebetween completely separating the two plates from each other. Guide rail holding extensions on the carrier plates at opposite sides of the gap have parts extending in a plane parallel to the carrier plane, the holding extension parts symmetrically projecting into, and engaging, grooves in the guide rail. The guide rail holding extensions have distal inclined abutment faces facing away from the groove-engaging parts, and a single wedge element is arranged between the inclined abutment faces in mating contact with therewith and wedged therebetween below the gap. Lock screws pass vertically and centrally through the wedge element and through the guide rail for affixing the guide rail to the holder, the lock screws being freely accessible through the gap between the carrier plates.

5 Claims, 2 Drawing Sheets

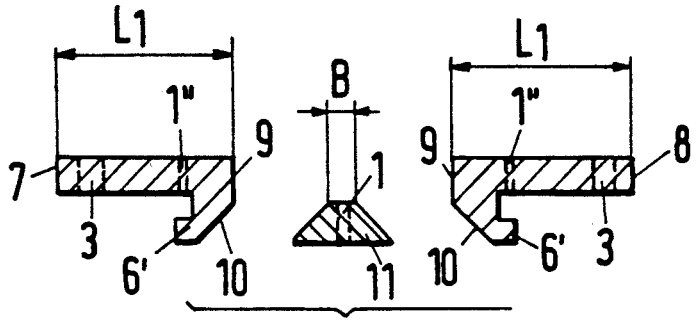
Fig. 3
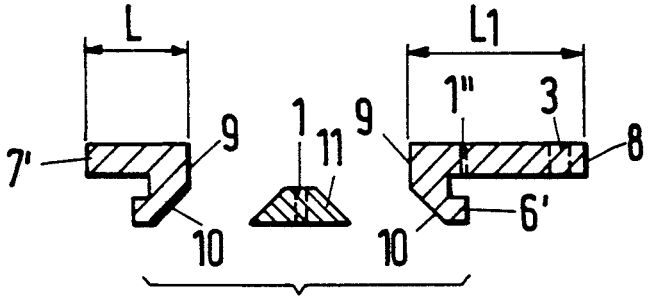
Fig. 3a
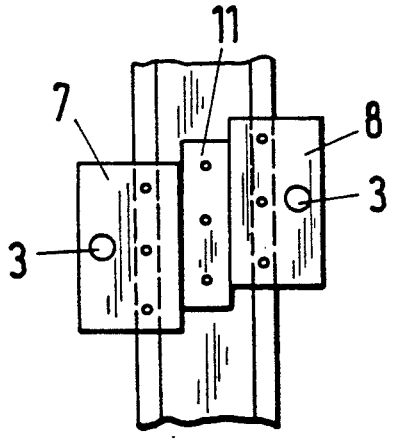
Fig. 4
Fig. 5
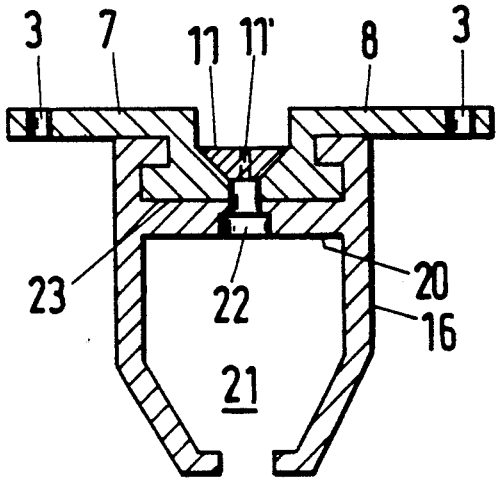

HOLDER FOR MOUNTING A GUIDE RAIL FOR A LIFT ON A CEILING

BACKGROUND OF THE INVENTION

1. Field of the Invention

The present invention relates to a holder for mounting a guide rail on a ceiling, particularly a guide rail for lifts for handicapped people. The holder comprises a carrier plate defining a plane and has mounting holes for attaching the carrier plate to the ceiling and guide rail holding extensions projecting into, and engaging, the guide rail. Lock screws clamp the guide rail to the holder.

2. Description of the Prior Art

A guide rail holder of this type has been disclosed in published British Patent Application No. 2,216,857. Such holders are required to affix guide rails, particularly for lifts for handicapped people, in a weight-bearing manner to the ceiling. Rollers of the lift engage the guide rail and can be displaced along the rail. For example, such guide rails may extend in dependence of the requirements along the ceiling between bath tub, wash basin, toilet and a bed, for instance.

Such guide rail holders satisfactorily serve their support function for the guide rail but have disadvantages with respect to the fixing of the holder on the ceiling (by dowelling and bolting). In this respect, it must be taken into consideration that several carrier plates must be suitably spaced along the guide rail, which requires accurate marking on the ceiling for each carrier plate so that the dowels may be in alignment with the mounting holes in the carrier plates. It may happen that a reinforcing beam cast into the ceiling is encountered when it is attempted to drill a dowel hole, which precludes the provision of a hole at this location. Furthermore, since the guide rails frequently require a curved path, the carrier plates with their guide rail holding extensions projecting into the guide rail grooves must have a sufficient tolerance with respect to the guide rail grooves to enable the holding extensions to be displaceable in the grooves in a curved path of the guide rail. If such relatively large tolerances between carrier plates and guide rail are to be avoided, correspondingly shorter carrier plates must be used.

SUMMARY OF THE INVENTION

It is accordingly an object of this invention to provide such a holder for mounting a guide rail on a ceiling, in which the carrier plates may be mounted on the guide rail in a simple manner and may have a small tolerance with respect to the grooves in the guide rail.

In accordance with the invention, this object is accomplished with a holder for mounting a guide rail on a ceiling, the holder comprising a carrier plate means defining a plane and comprised of two separate and unconnected parts attachable to the ceiling and defining a gap therebetween completely separating the two parts from each other. Guide rail holding extensions on the carrier plate means parts at opposite sides of the gap have parts extending in a plane parallel to the carrier plate means plane, the holding extension parts symmetrically projecting into, and engaging, grooves in the guide rail, and the guide rail holding extensions having distal inclined abutment faces facing away from the groove-engaging parts. A single wedge element is arranged between the inclined abutment faces in mating contact with therewith and wedged therebetween below the gap, and lock screws pass vertically and centrally through the wedge element and through the guide rail for affixing the guide rail to the holder, the lock screws being freely accessible through the gap between the carrier plate means parts.

In a guide rail holder according to the invention, the separate and unconnected carrier plate means parts may be adjusted relative to each other in a simple manner and the carrier plate means may be adjusted relative to the guide rail. The holders may be mounted at the desired location of the guide rail and may be clamped into the grooves of the guide rail by means of the wedge element. Because the carrier plate means is comprised of two separate and unconnected parts, the two carrier plate parts need not be in alignment, i.e. the mounting holes along the margins of the carrier plate means may be staggered from each other so that, when a faulty bore in the ceiling is encountered, the carrier plate part need only be displaced a little to be in alignment with another bore to be drilled. This staggered relationship of the two carrier plate parts is limited only by the requirement of maintaining the wedging force of the wedging element on both carrier plate parts. If the carrier plate has a width of, for example, 7 cm transversely to the guide rail, one part may be staggered relative to the other part by 3 to 4 cm.

Since the carrier plate means is comprised of two parts and these parts may be mounted directly at the desired location of the guide rail, mounting of such carrier plates in a guide rail curve is simplified despite a low tolerance relative to the grooves in the guide rail because the carrier plate need not be moved along the curved path. The necessary smaller distance between the two carrier plate parts in a curve makes no difference because the smaller distance is compensated by the wedging element, i.e. the wedging force of the wedging element is effective sooner when the two parts are clamped together.

According to advantageous embodiments of the present invention, the inclined abutment faces of the guide rail holding extensions may converge towards the ceiling, or they may diverge towards the ceiling, and the wedge element then has internally threaded through holes receiving the lock screws. The wedge element may have a cross section defining a regular trapezoid having two parallel sides, one of the trapezoid sides facing the gap, and the carrier plate then has a total width extending transversely to the guide rail which corresponds substantially to the combined widths of the carrier plate parts and the one trapezoid side extending transversely to the guide rail.

Furthermore, one of the carrier plate parts may have about half the width extending transversely to the guide rail of the other carrier plate part. In this case, the shorter carrier plate part need not be dowelled or bolted to the ceiling but serves only to hold the wedging element in bearing contact with both guide rail holding extensions. Such holders are, therefore, attached to the ceiling only on one or the other side of the holders. Although the wedging element is pressed against the mating inclined abutment faces of the guide rail holding extensions by the lock screws, the carrier plate parts may have additional lock screw mounting bores arranged above the guide rail holding extension parts projecting into the guide rail grooves.

BRIEF DESCRIPTION OF THE DRAWING

Preferred embodiments of this invention will now be described in more detail in connection with the accompanying drawing wherein

FIG. 3 is an exploded cross section showing the components of the holder of FIG. 2;

FIG. 3*a* is a like cross section showing another embodiment of the holder;

FIG. 4 is a fragmentary plan view of the guide rail and an associated holder whose holder components are staggered from each other; and FIG. 5 shows another embodiment of the holder in cross section.

DETAILED DESCRIPTION OF PREFERRED EMBODIMENTS

Figure 1:
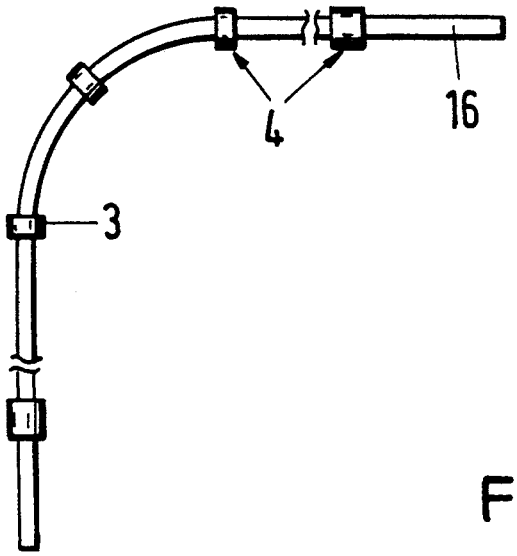
FIG. 1 is a plan view of a guide rail with several holders.
Figure 2:
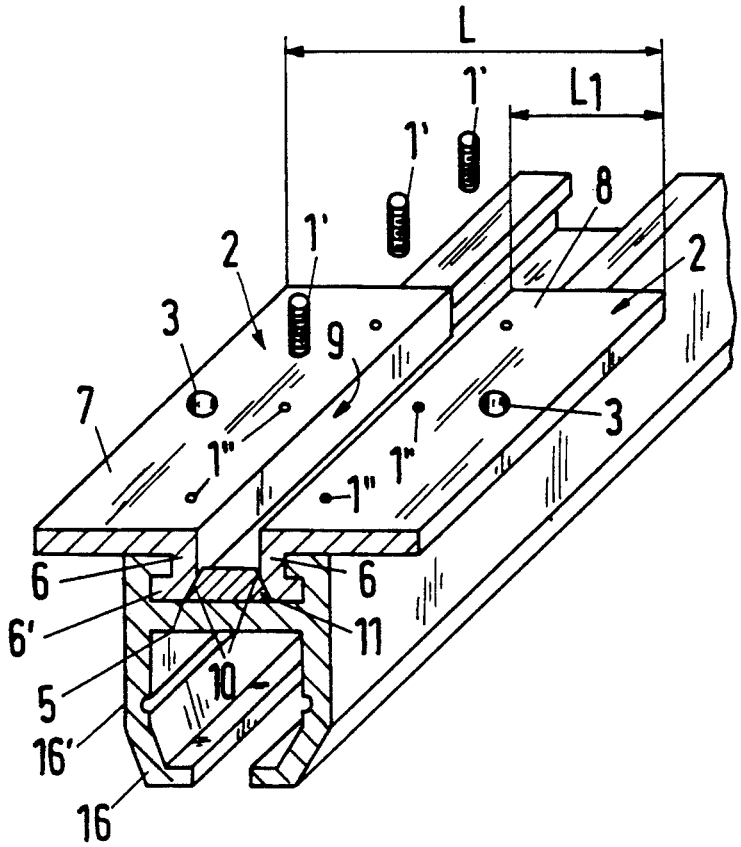
FIG. 2 is a perspective view showing a portion of the guide rail and an associated holder.

FIG. 1 illustrates by way of example a curved path of guide rail 16 attached to a ceiling by a succession of holders 4. A typical cross section of guide rail 16 is shown in FIG. 2. each holder comprises carrier plate means extending in plane E of the ceiling and comprised of two separate and unconnected parts 7 and 8 whose margins 2 have mounting holes 3 for dowelling or bolting the carrier plate means parts to the ceiling. Parts 7 and 8 have guide rail holding extensions 6 whose parts 6' project into, and engage, grooves 5 in guide rail 16 parallel to an adjacent the plane of the carrier plate means. Guide rail holding extensions 6 have distal faces 9 facing away from parts 6' and including inclined abutment faces 10. Single wedging element 11 is positioned between the inclined abutment faces and is in mating contact with inclined abutment faces 10. Lock screws 1' pass vertically and centrally through bores 1 in wedge element 11 and through guide rail 16 for affixing the guide rail to holder 4. The lock screws are freely accessible through the gap between carrier plate means parts 7, 8. If desired, the guide rail may be further fastened to the holder through mounting holes 1'' along the margins of parts 7 and 8 extending along the gap between the parts in vertical alignment with guide rail holding extension parts 6'.

In the embodiments of FIGS. 2, 3 and 3*a*, inclined abutment faces 10 of guide rail holding extensions 6 and the mating faces of wedge element 11 converge towards plane E. As also shown in these figures, wedge element 11 has a cross section defining a regular trapezoid having two parallel sides, one of the trapezoid sides facing the gap. The carrier plate means has a total width L extending transversely to guide rail 16 which corresponds substantially to the combined widths $L_1$ and B of carrier plate means parts 7, 8 and the one trapezoid side extending transversely to the guide rail.

Carrier plate means parts 7 and 8 may be inserted into grooves 5 of the guide rail at each desired location, together with wedge element 11, and are affixed to the guide rail in a fixed position by tightening lock screws 1' and screws inserted in holes 1'', the tightening of the screws causing wedge element 11 to be pressed against inclined abutment faces 10 and to be tightly wedged between the guide rails and carrier plate means parts 7, 8. This may be done not only if parts 7, 8 and wedge element 11 are in alignment, as shown in FIG. 2, but may also be effected if they are staggered from each other, as illustrated in FIG. 4.

If this is adequate or if required by the installation conditions, one of the carrier plate means parts 7' may have about half the width $L_1$ extending transversely to guide rail 16 of the other carrier plate means part 8, as shown in FIG. 3*a*. The width of part 7' is preferably so selected that the longitudinal edge of part 7' is flush with longitudinally extending face 16' of the guide rail.

The embodiment of FIG. 5 differs from those described hereinabove in that the mating contact faces of wedge element 11 and the guide rail holding extensions diverge towards plane E. The wedge element has internally threaded through holes 11' receiving the lock screws through recessed holes 22 in bottom 23 of guide rail 16 so that tightening of the screws will press the wedging element down against the mating inclined abutment faces of the guide rail holding extensions. This embodiment can be used with guide rails in which surface 20 of bottom 23 is freely accessible, i.e. bottom surface 20 of guide channel 21 of the guide rail must not carry an electrically conductive band. It has the advantage that, in case of need, any holder mounted on the guide rail may be loosened by unscrewing the lock bolts and all or some components of the holder may be repositioned.

I claim:

1. The combination of a guide rail and a holder for mounting sand guide rail on a ceiling, the holder comprising (a) a carrier plate means defining a plane and comprised of two separate and unconnected parts attachable to the ceiling and defining a gap therebetween completely separating the two parts from each other, (b) guide rail holding extensions on each of the two parts of the carrier plate means at opposite sides of the gap, (1) the guide rail having a respective groove at each of said sides of the gap and the grooves defining a plane parallel to the carrier plate means plane, and (2) the guide rail holding extensions having parts extending in the parallel plane, the parts of the holding extensions symmetrically projecting into, and engaging, the grooves in the guide rail, and the guide rail holding extensions having distal inclined abutment faces facing away from the parts of the holding extension, (c) a single wedge element arranged between and in mating contact with the abutment faces of the guide rail holding extensions and is also wedged below the gap, and (d) lock screws passing vertically and centrally through the wedge element and through the guide rail for affixing the guide rail to the holder, the lock screws being freely accessible through the gap between the parts of the carrier plate means.

2. The holder of claim 1, wherein the inclined abutment faces of the guide rail holding extensions converge towards the ceiling.

3. The holder of claim 1, wherein the inclined abutment faces of the guide rail holding extensions diverge towards the ceiling, and the wedge element has internally threaded through holes receiving the lock screws.

4. The holder of claim 1, wherein the wedge element has a cross section defining a regular trapezoid having two parallel sides extending transversely to the guide rail, one of the trapezoid sides facing the gap, and the carrier plate means has a total width which corresponds substantially to the combined widths of the parts of the carrier plate means and the one trapezoid side.

5. The holder of claim 1, wherein one of the parts of the carrier plate means has about half the width of the other part of the carrier plate means.

* * * * *